US006247203B1

(12) United States Patent
Kuo

(10) Patent No.: US 6,247,203 B1
(45) Date of Patent: Jun. 19, 2001

(54) POP-UP MECHANISM FOR AN EXTENDABLE HANDLE OF WHEELED LUGGAGE

(75) Inventor: Chung-Hsien Kuo, Pan-Chiao (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 09/478,995

(22) Filed: Jan. 7, 2000

(51) Int. Cl.[7] ..... A45C 7/00

(52) U.S. Cl. ..... 16/113.1; 190/115; 280/655; 280/655.1; 280/47.24; 280/47.26; 280/37

(58) Field of Search ..... 16/113.1; 190/115, 190/18 A, 15 R, 104, 14; 280/655, 655.1, 47.315, 47.18, 47.24, 47.26, 37, 47.371

(56) References Cited

U.S. PATENT DOCUMENTS 5,526,908 * 6/1996 Wang ..... 16/113.1
5,581,846 * 12/1996 Wang ..... 16/113.1
5,620,070 * 4/1997 Wang ..... 16/113.1
5,628,088 * 5/1997 Chen ..... 16/113.1
5,692,266 * 12/1997 Tsai ..... 16/113.1
5,727,898 * 3/1998 Lu ..... 16/113.1
5,781,965 * 7/1998 Lu ..... 16/113.1
6,141,828 * 11/2000 Kuo ..... 16/113.1

* cited by examiner

*Primary Examiner*—Chuck Y. Mah
(74) *Attorney, Agent, or Firm*—Dougherty & Troxell

(57) ABSTRACT

An improvement of the pop-up mechanism for an extendable handle of wheeled luggage is disclosed. The popup mechanism comprises an additional elastic device in the overlaying section of the sliding tube and the support tube for cooperating with a first elastic device and a fastening device. Once the push button is pressed by a hand the sliding tube locked by the pin of the push button is unlocked and thus the sliding tube moves downward a predetermined distance. In this manner, the hand pressing the push button previously will be able to leave the push button unattended. Then use the same hand to push down the sliding tube to its lowest locked position. As a result, the purpose of retracting the handle by a single hand is fulfilled.

4 Claims, 9 Drawing Sheets

POP-UP MECHANISM FOR AN EXTENDABLE HANDLE OF WHEELED LUGGAGE

REFERENCE TO RELATED APPLICATION

This application is related to a U.S. patent application Ser. No. 09/088,815, filed on Jun. 2, 1998, now U.S. Pat. No. 5,987,701 in the name of Chung-Hsien KUO and entitled "Pop-up Mechanism for an Extendable Handle on a Wheeled Luggage Case".

BACKGROUND OF THE INVENTION

1. Field of the Invention

The present invention relates to a pop-up mechanism, and more particularly to a pop-up mechanism for an extendable handle of wheeled luggage for allowing the handle to be extended and retracted in a pop-up manner by a single hand so as to increase convenience.

2. Description of Related Art

A wheeled luggage case is widely used by travelers at airports to carry personal belongings, which is equipped with wheels and an extendable handle that allows the user to easily and effortlessly carry the luggage case by pulling it on the ground. The extendable handle is normally retracted and locked in the luggage case and can be unlocked to be extended out for the user to pull the wheeled luggage case on the ground.

In most wheeled luggage cases, the extendable handle is usually provided with a pop-up mechanism that allows the handle to be extended out in a pop-up manner when a button is pressed so that the user can use the handle fast and conveniently.

Such pop-up mechanisms are, for example, disclosed in Kazmark, Jr. et al., U.S. Pat. No. 5,522,615, a Cart and Luggage Handle Assembly with an Actuator and Release Apparatus; Chen, U.S. Pat. No. 5,530,990, a Handle Assembly for Suitcase; Lu, U.S. Pat. No. 5,584,097, a Full Handle for a Truck; Liang, U.S. Pat. No. 5,639,109, a Collapsible Luggage Trolley, to name a few. These pop-up mechanisms, however, are quite complex in construction such that disassembly of the component parts for maintenance and repair would be difficult and thus it is laborious and time-consuming to carry out. Moreover, since the spring used for the pop-up action will be compressed for each use, it can suffer from elastic fatigue after long time of use and should therefore be replaced frequently. However, since these conventional pop-up mechanisms are quite complex in construction, the replacement of the spring will then involve a laborious work. Both assembly and disassembly are thus laborious and time-consuming to carry out. Therefore, the use of these conventional pop-up mechanisms would involve high the manufacturing and maintenance costs.

SUMMARY OF THE INVENTION

It is therefore an objective of the present invention to provide a pop-up mechanism for an extendable handle of wheeled luggage, which is simpler in construction than those in the prior art so that the manufacture and maintenance for the pop-up mechanism can be easily carried out and the costs thereof can thus be reduced.

In accordance with the foregoing and other objectives of the present invention, a novel pop-up mechanism for an extendable handle of a wheeled luggage case is provided. The pop-up mechanism is provided for use on an extendable handle on a wheeled luggage case for the purpose of locking the extendable handle at a retracted position and allowing a user to extend the extendable handle from the retracted and locked position in a pop-up manner, the extendable handle including a pair of parallelly elongated bars which are extendable from and retracted into a pair of tubes on the luggage case. The pop-up mechanism of the invention includes the following component parts:

a bezel body having a button; a pair of recessed portions each provided on each of said elongated bars; a pair of spring-biased raised portions each provided on an end of the bezel body; at least one fastening device being substantially a rectangular body comprising a through opening for mounting on each of said tubes; and at least one elastic driving device secured by the fastening device on each of said tubes, the elastic driving device being substantially a rectangular body having a cavity for receiving an elastic means and a slidable block seated on the elastic means; wherein the slidable block has a protruded portion having a width corresponding to a width of an elongated slot formed on a side of each said bars for being slidingly received therein such that when the extendable handle is pressed to a retracted position, each spring-biased raised portion is protruded into each corresponding recessed portion of said elongated bars for locking the extendable handle, while the protruded portion is slid downwardly along the slot to thereby compress the elastic means and thus move the slidable block to a lowest position in the elastic driving device; and when each spring-biased raised portion is retracted into the bezel body by pressing the button, the extendable handle is unlocked and pop-up immediately such that the protruded portion is slid upwardly along the slot by the expanding force of the elastic means and thus move the slidable block to a highest position in the elastic driving device.

It is another object of the present invention to provide a pop-up mechanism for an extendable handle of wheeled luggage, wherein the sliding tube is automatically unlocked and moves downward a predetermined distance when the push button is pressed. Such that the sliding tube is pushed down to the elastic device and locked.

It is further object of the present invention to provide a pop-up mechanism for an extendable handle of wheeled luggage, wherein the extension and retraction of the handle can be done by a single hand by pushing the push button so as to increase convenience.

It is still further object of the present invention to provide a pop-up mechanism for an extendable handle of wheeled luggage wherein the assembly and disassembly of components of the pop-up mechanism are relatively easy. Further, a reduction in the manufacturing cost and maintenance fee is possible for the pop-up mechanism.

The advantages of the present invention are realized by providing an additional (i.e., second) elastic device in the overlaying section of the sliding tube and the support tube and above the first fastening device for cooperating with the first elastic device and the fastening device as described in the above application for making possible of performing the extention and retraction of the handle by a single hand. The second elastic device comprises a sliding member, a guiding member, a sleeve member, and an elastic member wherein a sliding block of the sliding member is attached to the sliding tube; a U shaped arm disposed within a sliding seat of the sliding member in which the elastic member is put on a bottom pin of the U shaped arm and the bottom pin is inserted through a bottom hole of the sliding seat such that the top of the U shaped arm is attached to the bottom of the sleeve member so as to be secured within the support tube.

As to the operation of second elastic device, the sliding tube is unlocked when the push button is pressed such that the force applied on the elastic member is released. The sliding seat together with the sliding block will move downward a predetermined distance due to the expansion of the elastic member. Accordingly, the sliding tube is slided an identical predetermined distance into the support tube so as to allow the push button left unpressed. As a result, it is possible of sliding the sliding tube into the support tube completely. Thus, the purpose of retracting the handle by a single hand is fulfilled.

It is noted that the assembly of the sliding tube and the support tube and the second elastic device is by means of the sleeve member and thus, the disassembly of the same is simply by means of the detachment of the sleeve member. In brief, it is easy to assemble and disassemble the novel pop-up mechanism.

The above and other objects, features and advantages of the present invention will become apparent from the following detailed description taken with the accompanying drawings.

BRIEF DESCRIPTION OF THE DRAWINGS

The invention can be more fully understood by reading the following detailed description of the preferred embodiments, with reference made to the accompanying drawings, wherein.

DETAILED DESCRIPTION OF THE INVENTION

Figure 1:
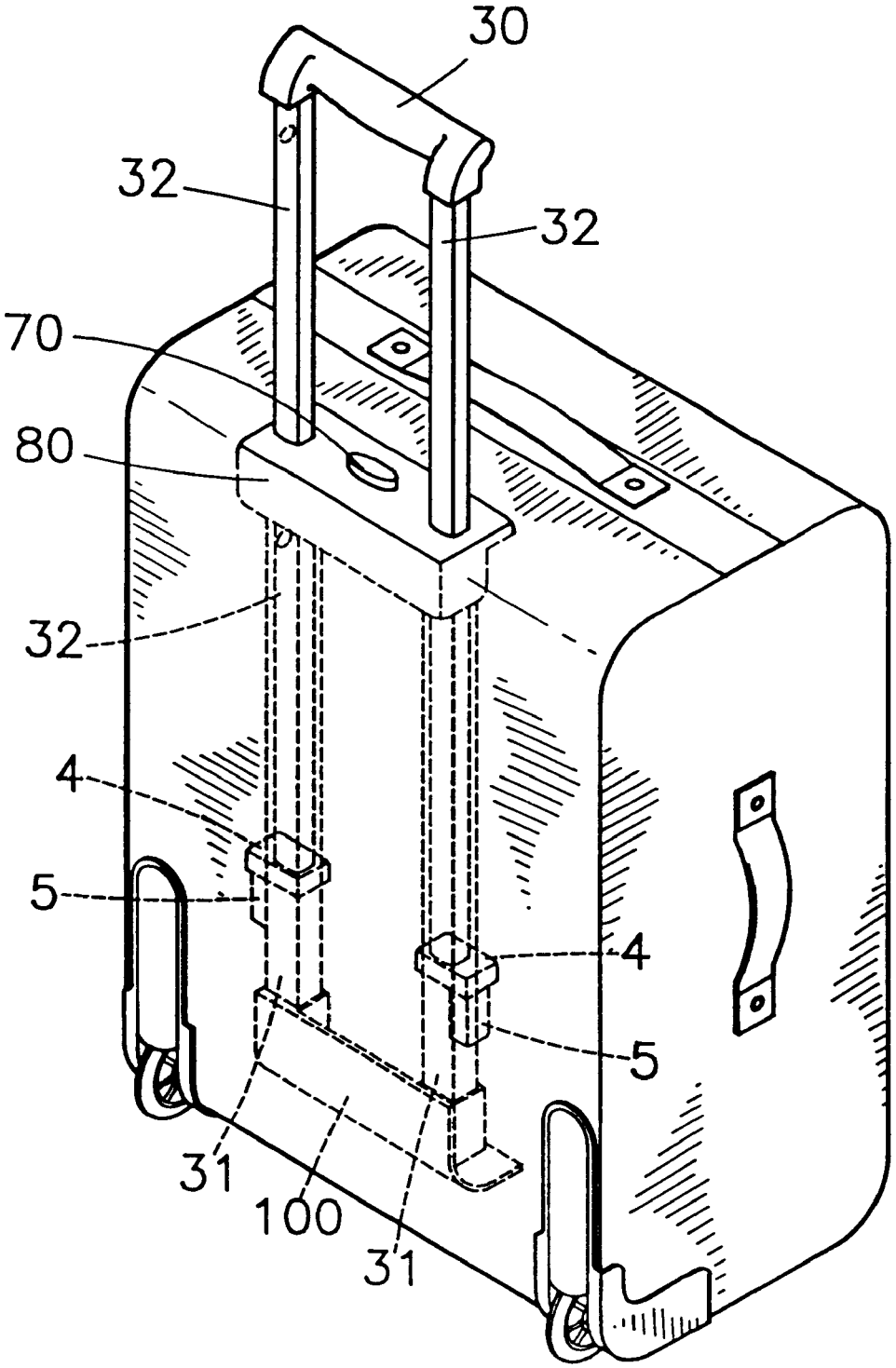
FIG. 1 is a schematic perspective view of a first embodiment of a wheeled luggage case of the present invention which is provided with the pop-up mechanism of the invention for its extendable handle.

FIG. 1 is a schematic perspective view of a wheeled luggage case which has an extendable handle provided with the pop-up mechanism of the invention. As shown, the wheeled luggage case includes an extendable handle which includes a handle 30 and a pair of elongated bars 32 which can be retracted into a pair of tubes 31 respectively. When the elongated bars 32 are fully retracted into the tubes 31, the handle 30 is rested on a bezel body 80. The user can unlock and pop up the extendable handle by pressing a button 70 provided on the top of the bezel body 80. The tubes 31 are mounted on a base support 100 provided on the bottom side of the luggage case. These component parts are substantially identical with those in the prior art.

The wheeled luggage case features the provision of the pop-up mechanism of the invention to allow the user to conveniently pull the extendable handle from the retracted and locked position so that the extendable handle can be easily extended for use. The popup mechanism includes a pair of fastening devices 4 and a pair of elastic driving devices 5. Each elastic driving device 5 is fastened by one fastening device 4 on one of the tubes 31.

Figure 2:
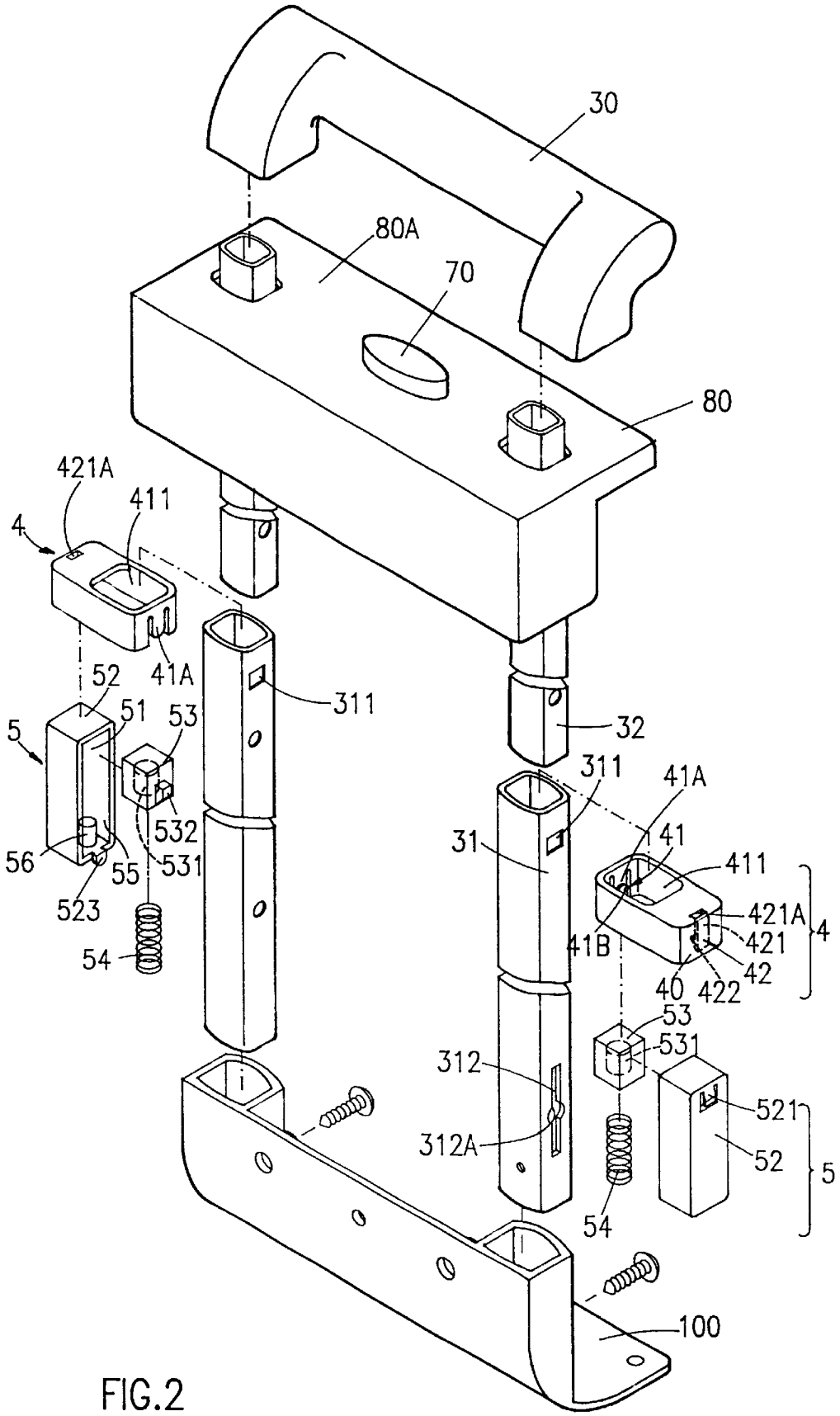
FIG. 2 is an exploded perspective view of the pop-up mechanism of the invention and thy extendable handle of FIG. 1.

Referring to FIG. 2, the fastening device 4 includes a main body 40 which is substantially a rectangular body formed with a first securing structure 41 on one side and a second securing structure 42 on the other. The main body 40 is formed with a square through opening 411 that allows the main body 40 to be sleeved on each tube 31. The first securing structure 41 allows the fastening device 4 to be secured in a position on the tubes 31 by securing the first securing structure 41 to an opening 311 in the outer wall of the tubes 31. The first securing structure 41 includes an elastic extension member 41A extended downwardly from the top of the sidewall of the square through opening 411, and a locking protrusion 41B is formed on the lower portion of said elastic extension member 41A. The second securing structure 42 includes a slot 421 formed in the inner wall on the inside of the main body 40. The top end of the slot 421 is formed with an opening 421A which extends through the top wall of the main body 40, and the bottom end of the slot 421 is formed with a hook-like structure 422. The second securing structure 42 is used to secure the elastic driving device 5 to the fastening device 4, which will be detailed later in this specification.

The elastic driving device 5 includes a rectangular main body 52 formed with a cavity 51 for accommodating a slidable block 53 and an elastic member, such as a spring 54. The spring 54 has one end inserted into a circular recess 531 formed on the bottom side of the slidable block 53 and the other end sleeved on a pin 56 formed on the inner wall in the cavity 51 of the main body 52. The spring 54 will be compressed when the slidable block 53 moves downwardly. When the elastic driving device 5 is mounted on the tube 31, the open side 55 of the cavity 51 faces towards the tube 31. The main body 52 of the elastic driving device 5 is formed with an integrally formed elastic bent piece 521 which can be hooked to the hook-like structure 422 in the main body 40 of the fastening device 4 so as to secure the elastic driving device 5 to the fastening device 4. When disassembled, the elastic driving device 5 can be separated from the fastening device 4 by simply using a screwdriver with a flat tip to insert into the opening 421A on the top end of the slot 421 to cause the bent piece 521 separated from the hook-like structure 422.

Further, the slidable block 53 is formed with an urging piece 532, and correspondingly, the tube 31 is formed with an elongated slot 312 which allows the urging piece 532, to be slidable therealong. A securing piece 523 is formed at the bottom end of the main body 52, which allows the main body 52 to be securely fastened to the tube 31 by securing the securing piece 523 to the bottom end of the elongated slot 312. Further, the elongated slot 312 is formed with a wide opening 312A in the middle which allows the securing piece 523 on the main body 52 to pass therethrough such that the securing piece 523 is secured in the cavity of the tube 31 and abutted on the bottom end of each elongated bar 32 of the handle 30.

The operation of the pop-up mechanism of the invention is described in the following with reference to FIGS. 3 and 4.

Figure 3:
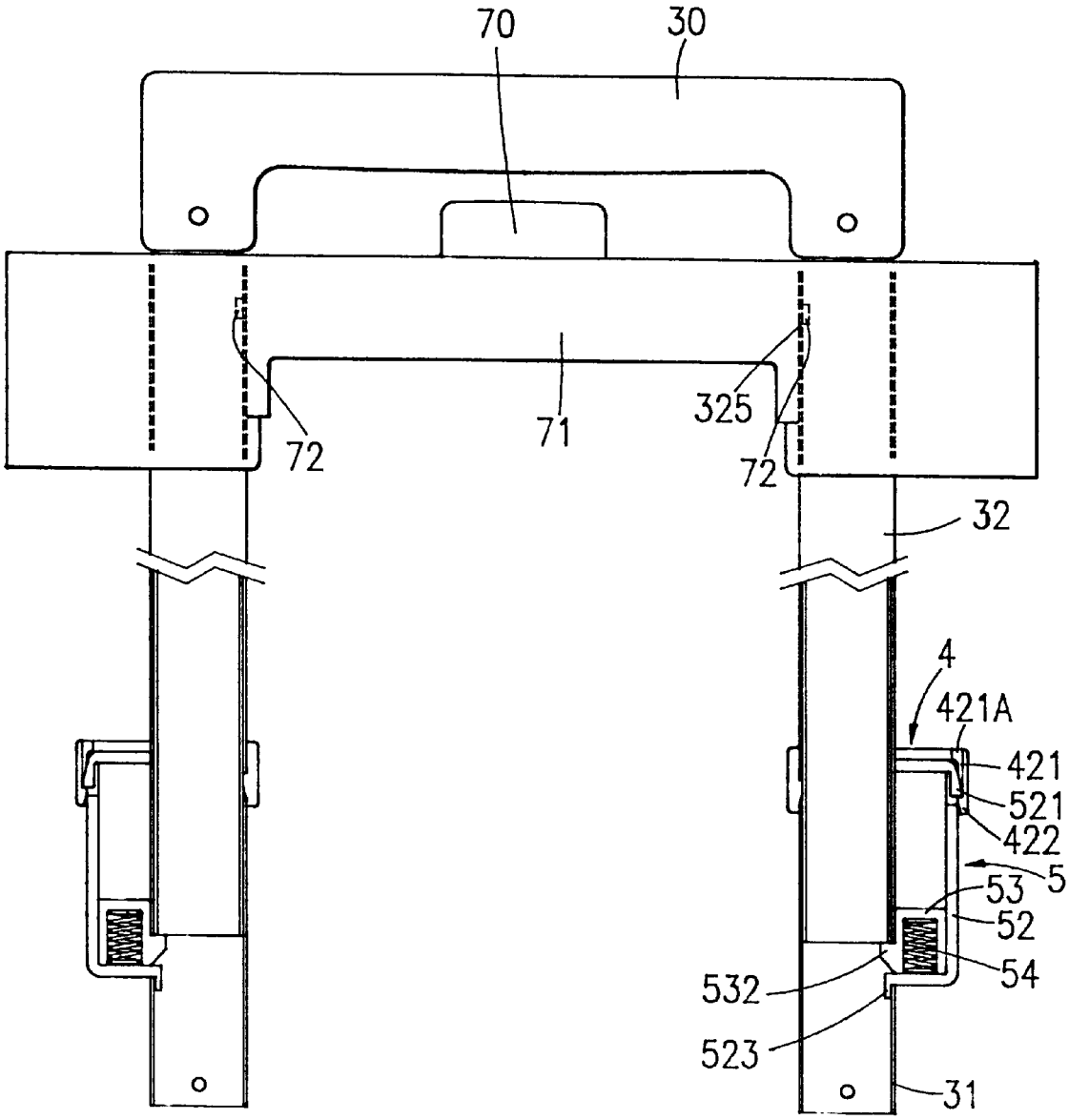
FIG. 3 is a schematic side view of a first embodiment of the pop-up mechanism of the invention when the extendable handle is retracted.

FIG. 3 is a schematic side view of the pop-up mechanism of the invention when the extendable handle is in a retracted position. As shown, when in a retracted position, the elongated bars 32 of the handle 30 are retracted into the tubes 31, causing the bottom of the tubes 31 to be urged against the urging piece 532 on the slidable block 53 such that the slidable block 53 is moved to a lowest position in the main body 52 of the elastic driving device 5, thus compressing the spring 54. In this condition, the upper stopper 325 on the elongated bar 32 is stopped by a pin 72 formed on the supporting body 71 so that the elongated bars 32 can be maintained in the retracted position.

Figure 4:
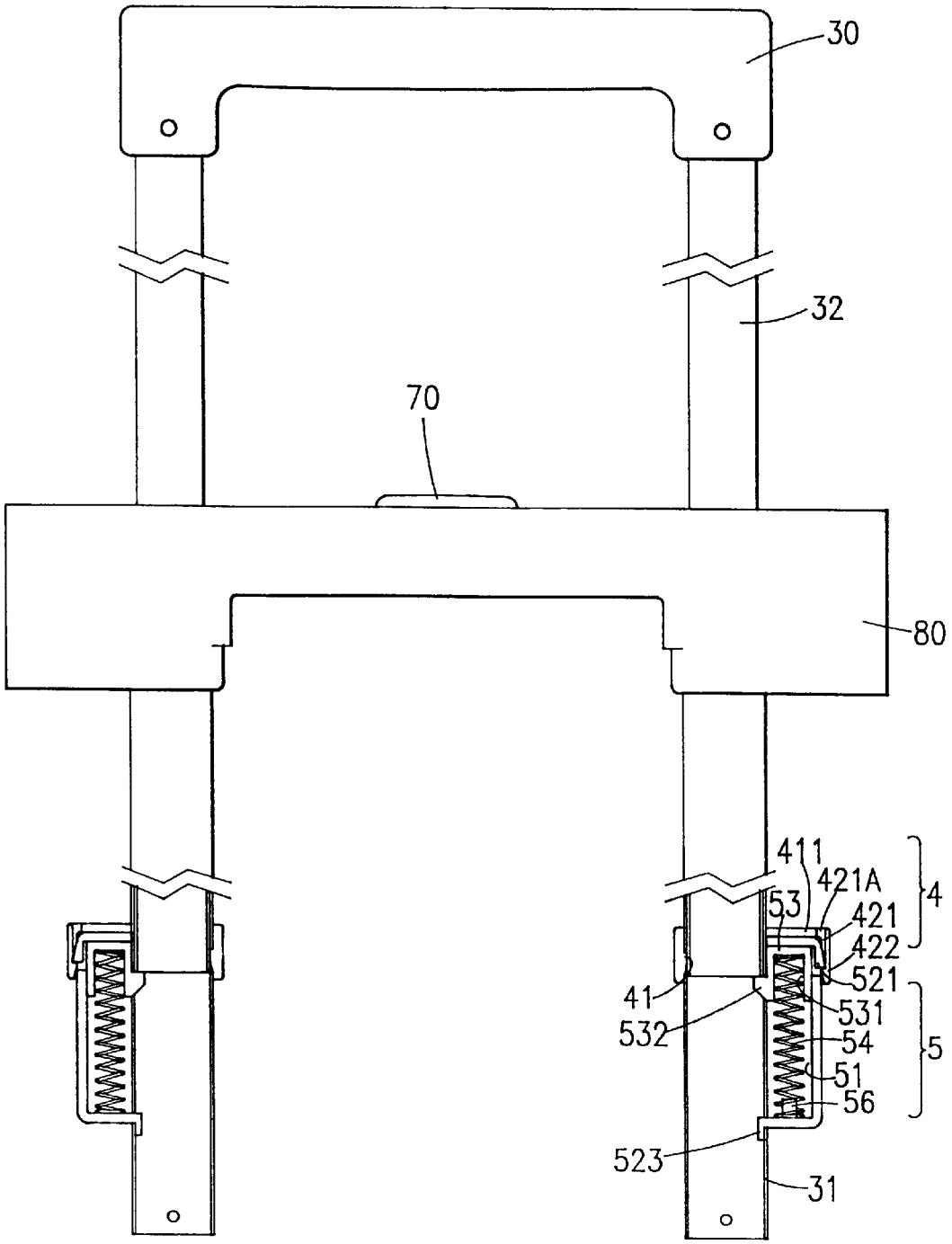
FIG. 4 is a schematic side view of a first embodiment of the pop-up mechanism of the invention when the extendable handle is popped up.

Further, as shown in FIG. 4, when the user presses on the button 70, the upper stopper 325 is unconstrained by the pin 72. Consequently, due to the elastic force of the compressed spring 54, the slidable block 53 will be pushed upwardly, thereby allowing the urging piece 532 to urge against the bottom of the elongated bars 32 and thus push them upwardly. As a result, the handle 30 is popped up and the user is allowed to conveniently grip the handle 30 to pull the luggage case on the ground.

It is apparent from the foregoing description that in accordance with the invention, the assembly and disassembly of the component parts of the pop-up mechanism of the invention can be easily carried out than those in the prior art, resulting in a reduction in the manufacturing and maintenance costs.

Figure 5:
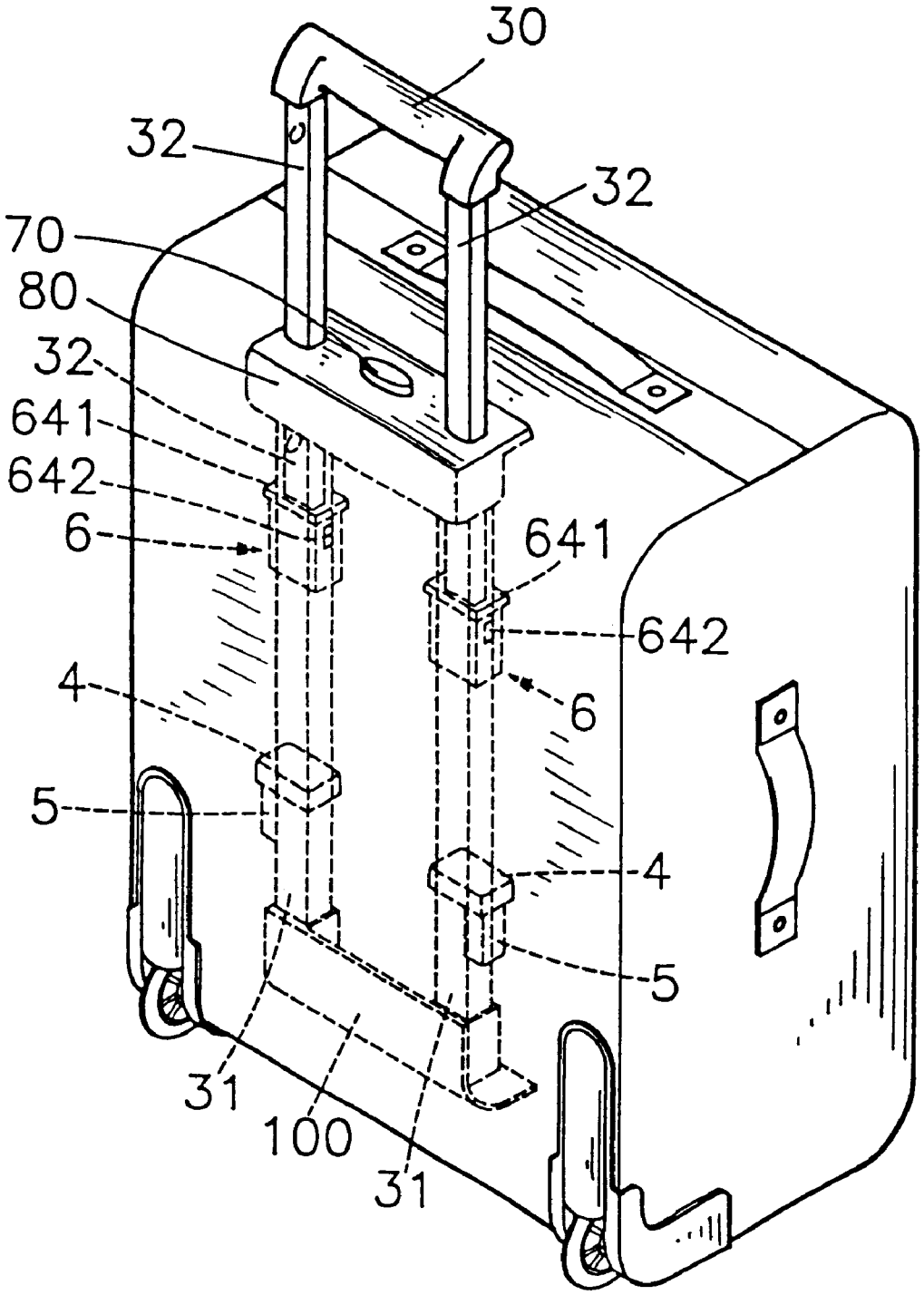
FIG. 5 is a perspective view of a second embodiment of a pop-up mechanism for an extendable handle of wheeled luggage of the present invention.
Figure 6:
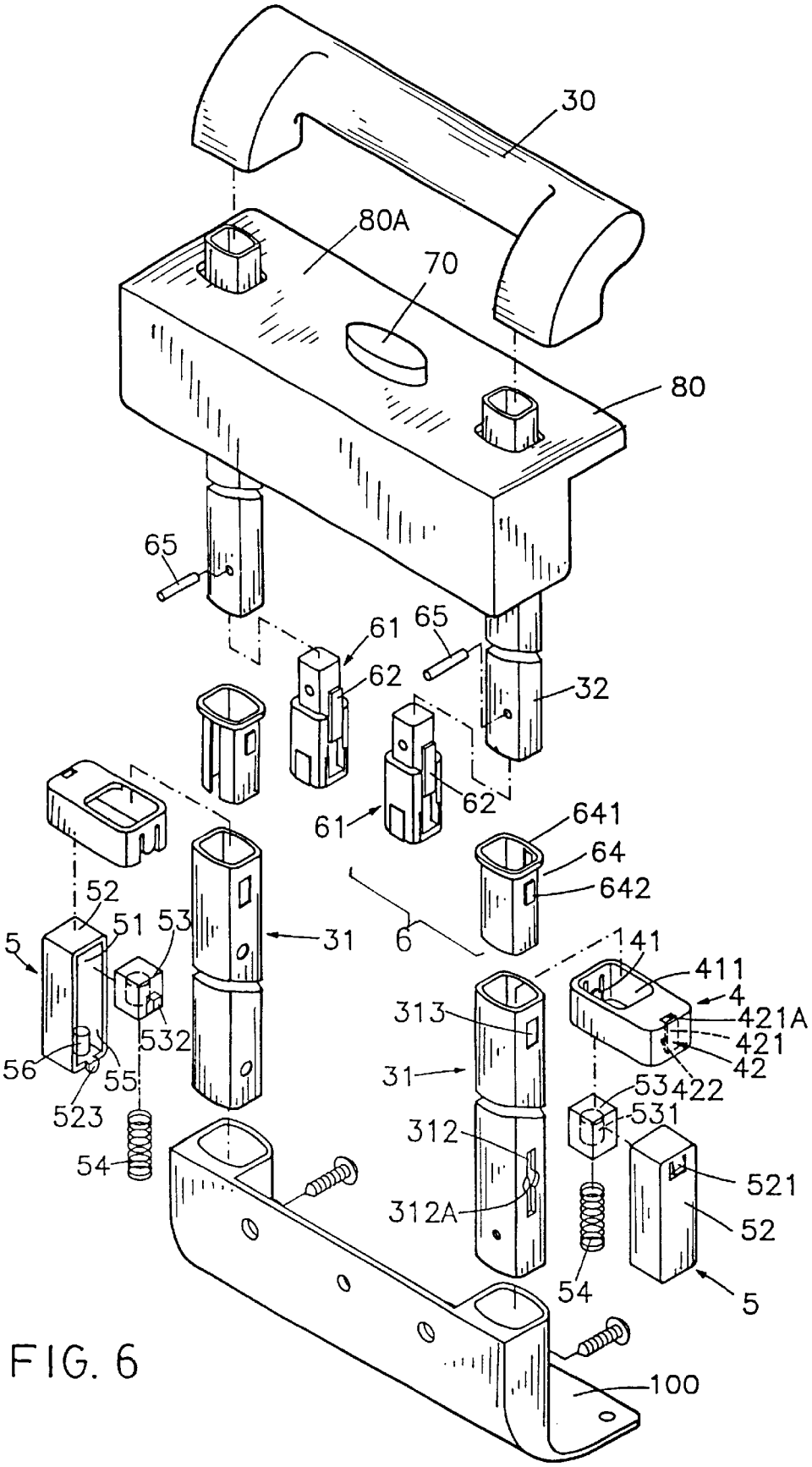
FIG. 6 is an exploded view of a second embodiment of the pop-up mechanism of the present invention.
Figure 7:
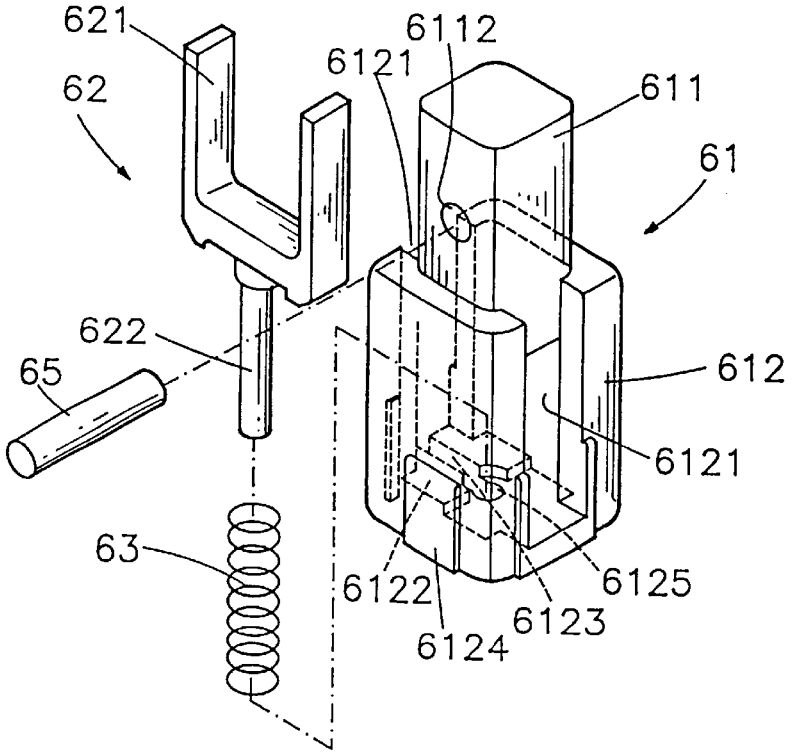
FIG. 7 is an exploded view of a second embodiment of the elastic device of the present invention.
Figure 8:
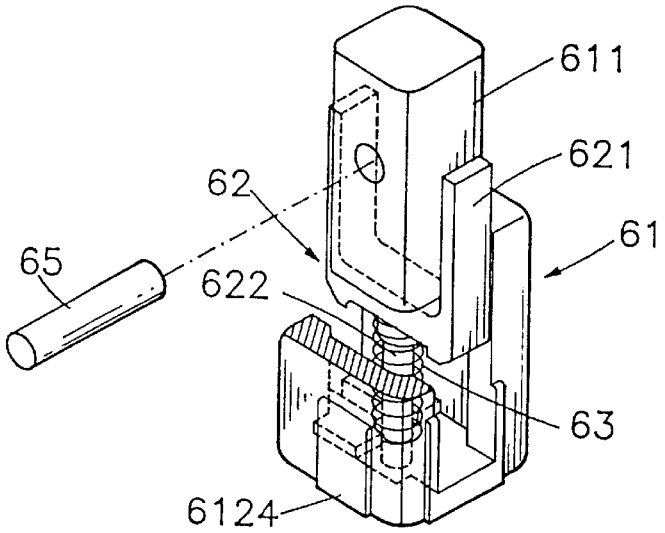
FIG. 8 is a partial sectional and partial perspective view of a second embodiment of the elastic device of the present invention.

As to a second preferred embodiment of the present invention, there are some components of the luggage, such as, the handle grip 30, the brace 80, the push button 70, the elastic device 5, the fastening device 4, the base 100, the sliding tube 32 and the support tube 31 as shown in FIGS. 5–6 are the same as the above first embodiment of the invention and thus the detailed descriptions will be omitted herein for the sake of brevity.

Referring FIGS. 5–9, the novel feature of the second preferred embodiment of the present invention is that an additional (i.e., second) elastic device 6 is provided in the overlaying section of the sliding tube 32 and the support tube 31 and above the first fastening device 4 and the elastic device 5. A pair of slots 313 each is provided on two opposite sides of the support tube 31.

The elastic device 6 comprises a sliding member 61, a guiding member 62, an elastic member 63, and a sleeve member 64. The sliding member 61 comprises a sliding block 611 and a sliding seat 612. The sliding seat 612 is hollow. A pair of vertical openings 6121 each is provided on two opposite sides of the sliding seat 612. A horizontal opening 6123 is extended from the bottom of one of the openings 6121 to the center of a bottom 6124 of the sliding seat 612 for attaching to a center hole 6125. A pair of blocking members 6122 each is provided on two opposite sides of the opening 6123. The lower half of the sliding block 611 is clung to the sliding seat 612, thus providing the fit setting of the sliding block 611 onto the sliding seat 612. Accordingly, the sliding block 611 and the sliding seat 612 are able to move as a whole. A hole 6112 is provided on a side of the sliding block 611. A locking pin 65 is inserted through the hole 6112 for firmly securing the sliding block 611 to the sliding tube 32 such that the sliding block 611 and the sliding tube 32 are able to move as a whole. The guiding member 62 comprises a U shaped arm 621 and a vertical pin 622. The sleeve member 64 has a top flange 641 and two projections 642 disposed on two opposite sides thereof.

In the procedure of assembling the sliding member 61, the guiding member 62, and the elastic member 63, the elastic member 63 is put on the vertical pin 622 first; and then the U shaped arm 621 is slantingly moved through the the left opening 6121 to be loosely attached to the two opposite sides of the sliding block 611; and then the pin 622 is slantingly moved through the opening 6123 on the bottom 6124 of the sliding seat 612 to the hole 6125, the pin 622 is further inserted through the hole 6125 such that the arm 621 has adequate space to keep upright in order to be clung onto the sliding block 611; and finally the elastic member 63 is stopped by the blocking members 6122 for received between the bottom of the arm 621 and the bottom 6124 of the sliding seat 612. As a result, the movement of the sliding member 61 is controlled by the compression and expansion of the elastic member 63.

In the procedure of assembling the elastic device 6 to the overlaying section of the sliding tube 32 and the support tube 31, it is required to attach the elastic device 6 to the top of the support tube 31 by the sleeve member 64; and then each projection 642 is clung into each corresponding slot 313 for being secured therein and the top flange 641 is attached to and flush on the top of the support tube 31 (see FIGS. 9–10); and then attach the sliding block 611 of the sliding member 61 to the bottom of the sliding tube 32; and finally, insert the top of the sliding tube 32 from the bottom of the support tube 31 until the top of the sliding tube 32 is extended above the top of the sleeve member 64. The disassembly of the same is simply by means of the detachment of the sleeve member 64 which is a reversal of the above assembly procedure.

Figure 9:
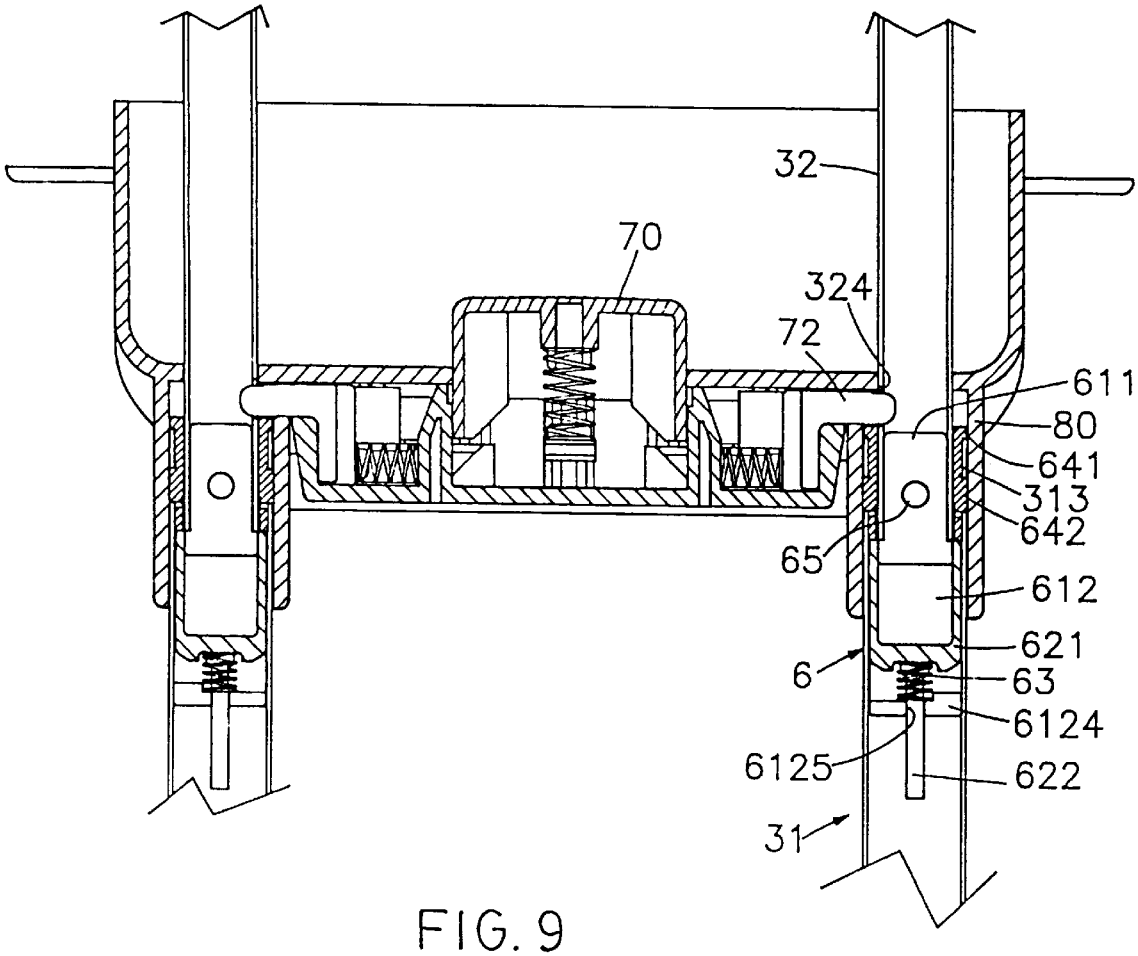
FIG. 9 is a schematic sectional view of a second embodiment of the pop-up mechanism of the present invention when the sliding tube is fully extended.
Figure 10:
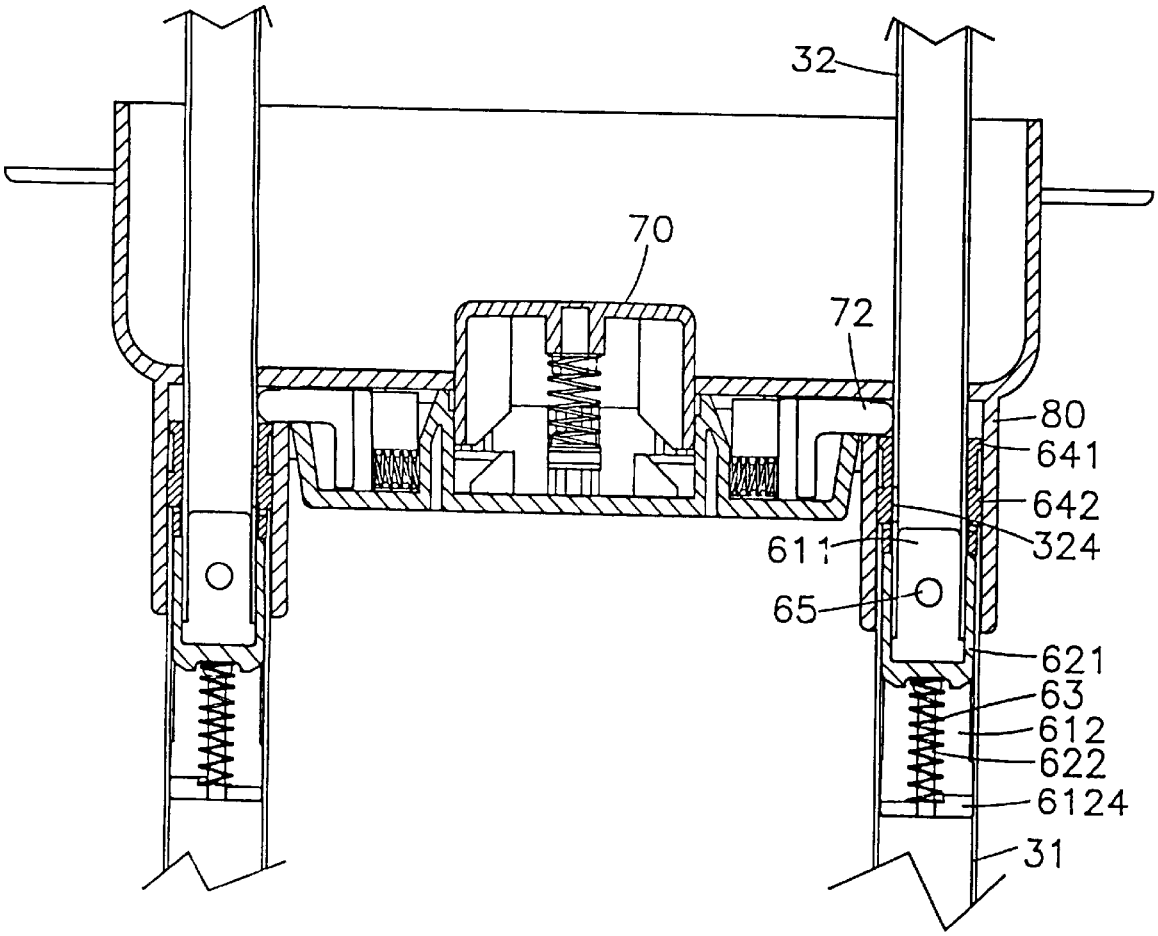
FIG. 10 is a schematic sectional view of a second embodiment of the pop-up mechanism of the present invention in which the sliding tube is retracted a predetermined distance when the push button is pressed.

The operation of the pop-up mechanism is shown in FIGS. 9–10.

Referring to FIG. 9, there is shown the sliding tube 32 in a fully extended position. A lower slot 324 of the sliding tube 32 is provided on a side facing the elastic device 6 for allowing the retractable pin 72 (note: the structure and operation of the retractable pin 72 are prior art and thus its description is omitted herein for the sake of brevity) inserted into and locked therein. As shown, the sliding tube 32 and the elastic device 6 are on the highest position. The sliding member 61 of the elastic device 6 forces the top of the U shaped arm 621 stop in the bottom edge of the sleeve member 64 by means of the uplift force of the sliding tube 32 applied on the sliding block 611. Accordingly, the elastic member 63 is compressed so as to move the sliding seat 612 of the sliding member 61 to the highest position.

As shown in FIG. 10, if a user wants to retract the sliding tube 32 for storage, he/she should press the push button 70. As such, the retractable pin 72 is retracted into the push button 70 and thus the sliding tube 32 and the sliding member 61 are unlocked. As a result, the force applied on the elastic member 63 by the bottom 6124 of the sliding seat 612 is released. Accordingly, the elastic member 63 returns to its original form and thus move the bottom 6124 a predetermined distance. Consequently, the sliding seat 612 and the sliding block 611 move downward along the two opposite sides of the U shaped arm 621 of the guiding member 62. Accordingly, the sliding tube 32 moves downward the same predetermined distance for keeping the retractable 72 unlocked. Here, the hand pressing the push button 70 previously will be able to leave the push button 70 unattended. Then use the same hand to push down the sliding tube 32 until the pin 72 is inserted into an upper slot (not shown) of the sliding tube 32 and locked therein. As a result, the purpose of retracting the handle by a single hand is fulfilled.

While the invention herein disclosed has been described by means of specific embodiments, numerous modifications and variations could be made thereto by those skilled in the art without departing from the scope of the invention set forth in the claims.

What is claimed is:

1. A pop-up mechanism for an extendable handle of wheeled luggage comprising:

a push button of the retractable handle having a retractable pin;

a support tube;

a sliding tube adapted to be slidably movable within the support tube;

an elastic device provided on the sliding tube comprising:

a sleeve member disposed on the top of the support tube;

a sliding member including a sliding block and a hollow sliding seat for receiving a lower portion of the sliding block therein thereby attaching to the sliding tube by means of the sliding block;

a guiding member provided within a space between the sliding block and the sliding seat including a U shaped arm and a vertical pin such that the sliding block and the sliding seat are adapted to be slidable in parallel to the U shaped arm; and an elastic member put on the vertical pin having an upper end attached to a bottom of the U shaped arm and a lower end attached to a bottom of the sliding seat;

wherein the pin of the push button is retracted into the sliding tube, and once the pin is retracted into the push button by pressing the push button the sliding tube is unlocked and thus the elastic member is expanded to move the sliding seat along with the sliding block downward a predetermined distance and accordingly the sliding tube moves downward the corresponding predetermined distance thereby enabling to operate the handle by a single hand.

2. The pop-up mechanism for an extendable handle of wheeled luggage of claim 1, wherein the sleeve member has a top flange and two projections disposed on two opposite sides thereof such that each of the projections is clung into a corresponding slot of the support tube for being secured therein and the top flange is attached to and flush on the top of the support tube and the U shaped arm is stopped by the bottom of the sleeve member so as to compress the elastic member when the sliding member and the sliding tube moves upward, and thus move the sliding member downward by the expansion of the elastic member when the push button is pressed.

3. The pop-up mechanism for an extendable handle of wheeled luggage of claim 1, wherein the sliding seat has an empty space within it; a pair of vertical openings each provided on two opposite sides of the sliding seat; a hole on a center of the bottom thereof; a horizontal opening is extended from the bottom of one of the openings to the center of the bottom of the sliding seat for attaching to the hole; and a pair of blocking members each provided on two opposite sides of the opening so as to be capable of clinging to the lower portion of the sliding block.

4. The pop-up mechanism for an extendable handle of wheeled luggage of claim 1, wherein the U shaped arm is slantingly moved through the opening to loosely attached to the two opposite sides of the sliding block; and the pin is slantingly moved through the opening on the bottom of the sliding seat to the hole in which the pin is further inserted through the hole such that the arm has adequate space to keep upright in order to be clung onto the sliding block.

* * * * *